US008469199B2

(12) United States Patent
Grönvall et al.

(10) Patent No.: US 8,469,199 B2
(45) Date of Patent: Jun. 25, 2013

(54) SCREEN AND SCREEN ELEMENT

(75) Inventors: Lars Grönvall, Trelleborg (SE); Kalle Larsson, Trelleborg (SE)

(73) Assignee: Metso Minerals (Sweden) AB, Trelleborg (SE)

( * ) Notice: Subject to any disclaimer, the term of this patent is extended or adjusted under 35 U.S.C. 154(b) by 685 days.

(21) Appl. No.: 11/662,863

(22) PCT Filed: Sep. 9, 2005

(86) PCT No.: PCT/SE2005/001303

§ 371 (c)(1), (2), (4) Date: May 21, 2008

(87) PCT Pub. No.: WO2006/031176

PCT Pub. Date: Mar. 23, 2006

(65) Prior Publication Data

US 2009/0050539 A1 Feb. 26, 2009

Related U.S. Application Data

(60) Provisional application No. 60/609,980, filed on Sep. 15, 2004.

(30) Foreign Application Priority Data

Sep. 15, 2004 (SE) ..... 0402219

(51) Int. Cl.
*B07B 1/46* (2006.01)

(52) U.S. Cl.
USPC ..... 209/405; 209/399; 209/409

(58) Field of Classification Search
USPC ..... 209/397, 399, 405, 408, 409, 412, 209/931
See application file for complete search history.

(56) References Cited

U.S. PATENT DOCUMENTS 4,141,821 A * 2/1979 Wolff ..... 209/405
4,265,742 A * 5/1981 Bucker et al. ..... 209/399

(Continued)

FOREIGN PATENT DOCUMENTS

DE 2754044 4/1979
DE 2754374 A1 6/1979

(Continued)

OTHER PUBLICATIONS

Examiners Report of the Intellectual Property Office of Canada dated Dec. 19, 2011, in counterpart Application No. 2,579,136.

(Continued)

*Primary Examiner* — Joseph C Rodriguez
(74) *Attorney, Agent, or Firm* — Kinney & Lange, P.A.

(57) ABSTRACT

A screen element (2) of a screen (1) has longitudinal sides adapted to be arranged in a longitudinal direction of a screen frame (4) and transverse sides adapted to be arranged in a transverse direction of the screen frame (4). The transverse sides of the screen element (2) are provided with at least one projection (6) and/or at least one recess (7) for locking engagement, in a direction transversely to the plane of the screen element (2), with a corresponding projection (6) and/or recess (7) on neighboring screen elements arranged in the screen frame (4). A screen (1) with a screen element (2) arranged in a screen frame (4) is also disclosed.

13 Claims, 5 Drawing Sheets

U.S. PATENT DOCUMENTS

| | | | | |
|---|---|---|---|---|
| 4,661,245 | A * | 4/1987 | Rutherford et al. | 209/399 |
| 4,839,045 | A * | 6/1989 | Wildner | 210/228 |
| 4,885,040 | A * | 12/1989 | Wolff | 156/244.18 |
| 4,892,767 | A * | 1/1990 | Freissle | 428/52 |
| 5,049,262 | A * | 9/1991 | Galton et al. | 209/399 |
| 5,735,409 | A * | 4/1998 | Malmberg | 209/399 |
| RE38,303 | E | 11/2003 | Askew | |
| 7,063,214 | B2 * | 6/2006 | Schulte et al. | 209/405 |
| 7,296,685 | B2 * | 11/2007 | Malmberg | 209/405 |
| 7,717,269 | B2 * | 5/2010 | Bacho et al. | 209/399 |

FOREIGN PATENT DOCUMENTS

| | | | |
|---|---|---|---|
| DE | 4136898 | | 5/1993 |
| EP | 0026961 | | 3/1980 |
| EP | 0167999 | A2 | 1/1986 |
| EP | 0669170 | | 8/1995 |
| ES | 2104089 | T3 | 10/1993 |
| GB | 2245191 | | 1/1992 |
| RU | 2001701 | C1 | 10/1993 |
| RU | 2101100 | C1 | 10/1998 |
| WO | 8402290 | | 6/1984 |
| WO | WO 8909509 | | 3/1989 |
| WO | WO 9833604 | | 8/1998 |

OTHER PUBLICATIONS

Office Action of the Argentina National Administration of Patents dated Nov. 25, 2011 in counterpart Application No. AR 054708.

* cited by examiner

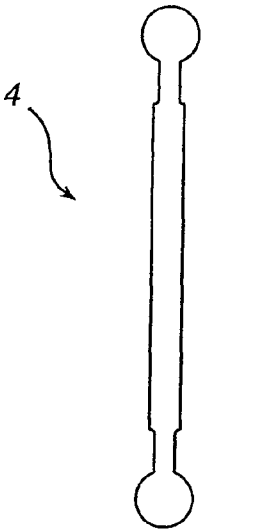
Fig. 5a
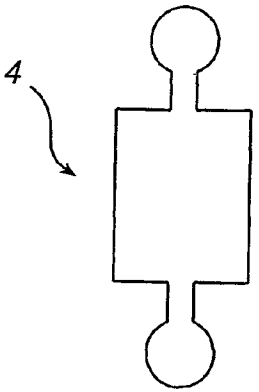
Fig. 5b
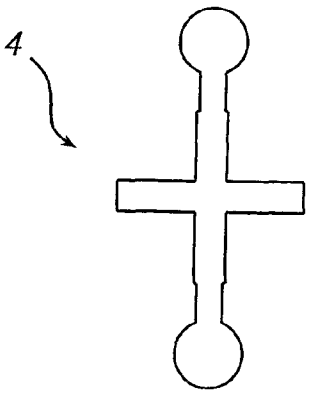
Fig. 5c
Fig. 5d
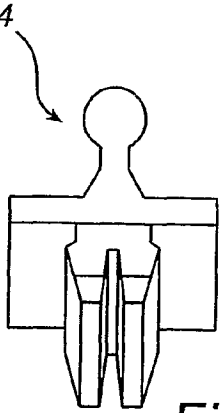
Fig. 5e
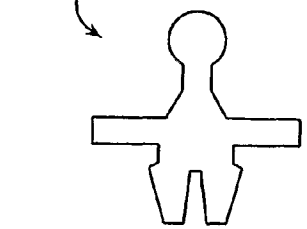
Fig. 5f

SCREEN AND SCREEN ELEMENT

FIELD OF THE INVENTION

The present invention relates to a screen element adapted to be arranged in a screen frame, which has longitudinal sides adapted to be arranged in a longitudinal direction of the screen frame and transverse sides adapted to be arranged in a transverse direction of the screen frame. The invention also relates to a screen, which has a screen frame and screen elements arranged in the screen frame, the screen elements having longitudinal sides arranged in a longitudinal direction of the screen frame and transverse sides arranged in a transverse direction of the screen frame.

BACKGROUND ART

Screen elements and screens of the above type are known, for instance, from EP-A-26 961 and US-RE 38,303 E which disclose different types of screens with screen elements arranged in a screen frame.

These screens have several advantages compared with those of earlier generations since individual screen elements can be exchanged when worn out, and since this exchange is a relative simple procedure which can be performed without requiring much work and equipment.

Since screen decks of the type above are subjected to longitudinal forces and also have screen elements arranged on a frame comprising longitudinally oriented bars, the screen elements must be locked somehow in the longitudinal direction to prevent sliding. A conventional way of achieving this is screwing into the side walls of the screen frame.

The screen elements should have an active surface that is as large as possible. The active surface is normally limited by the rigidity of the screen element since a screen element of lower strength requires supporting sections arranged at shorter intervals, which results in an increased dead surface of the screen element. Nevertheless, letting the entire screening surface consist of a single screen element and reducing the number of supporting points to a minimum does not constitute a convenient alternative. Such a method would certainly provide a maximum surface, but at the price of very high operating expenses since it would be necessary to exchange the entire screen deck also in case of local wear.

Consequently it is desirable to have a screen deck with a large active surface and high stability, on which it would be easy to exchange individual elements.

WO 89/08509 discloses what is referred to as a step deck, i.e. a screen where the successively arranged screen elements overlap each other to form a stepped screening surface.

SUMMARY OF THE INVENTION

The present invention intends to satisfy the above criteria and solve the above-mentioned problems by providing a new screen element and a new screen of the type stated by way of introduction.

These objects are achieved by means of a screen element according to claim 1. Preferred embodiments are defined in claims 2-12.

The above-mentioned objects are also achieved by a screen according to claim 13, preferred embodiments being defined in claims 14-20.

The transverse sides of the inventive screen element are provided with at least one projection and/or at least one recess. As a result, neighbouring screen elements can engage each other lockingly in a direction transversely to the plane of the screen element. Neighbouring elements are thus held together in the vertical direction and the risk of forming gaps between the short sides of neighbouring screen elements is reduced, which in turn reduces the need for a support frame in the transverse direction.

It is preferred for the screen element to have on its underside an undercut groove, which simplifies the snap locking to the screen frame.

Preferably, the undercut groove extends in the longitudinal direction of the screen frame to be attached to a longitudinal attachment section of the screen frame.

An inventive screen element is further made of elastomeric material and preferably of elastomeric material with two different hardnesses. This provides stability and rigidity while at the same time great abrasion resistance is ensured.

According to a characteristic feature, the upper side of the screen element has a lower hardness than the underside of the screen element so as to provide a stable and rigid structure with an abrasion-resistant surface.

The elastomeric material adjacent to the undercut groove preferably has two different hardnesses, so that the material on one groove side adapted to face another screen element has a lower hardness than on the opposite side of the groove. With snap locking to the screen frame, this results in bulging of the softer side of the groove facing another element, which in turn establishes an improved seal between neighbouring elements.

The elastomeric material mentioned above preferably is polyurethane (PU), since screen elements of this material are suitable for the technical purpose and also cost-effective to manufacture.

The polyurethane screen element has, if required, a reinforcement of polycarbonate resin (PC). Polycarbonate resin has been found to bond excellently to polyurethane in manufacture and ensures excellent reinforcing properties. Moreover a PC-reinforced PU material has the advantage, compared with a PU material reinforced with, for instance, steel, that it is easy and inexpensive to degrade once it is worn out.

An inventive screen element preferably has at least one projection and/or at least one recess which are arranged in the long side thereof. They allow locking engagement with a corresponding projection and recess in the long sides of neighbouring screen elements. The engagement ensures that the screen elements do not slide relative to each other.

The projection/projections and recess/recesses of the screen element is/are preferably arranged in such a manner that the screen element when rotated half a turn about an axis in the normal direction of the screening surface has the same circumferential shape. This symmetry makes it possible to turn over an individual screen element, for instance in case of uneven wear on the surface of the screen element.

According to a characteristic feature, the underside of the screen element is cambered at the short sides. Camber increases the rigidity of the screen element in the transverse direction and, together with the locking engagement of the short sides, results in the screen frame not requiring any supporting devices in the trans-verse direction, even when subjected to high loads.

A screen according to the present invention has a screen frame and comprises screen elements which are arranged in the screen frame with longitudinal sides in the longitudinal direction of the screen frame and trans-verse sides in the transverse direction of the screen frame. Moreover the short sides of the screen elements are provided with at least one projection and/or at least one recess for locking engagement with a corresponding projection and/or recess on neighbouring screen elements arranged in the screen frame. The engagement locks the screen elements to each other in the thickness direction of the screen elements.

In one embodiment, the screen elements of the screen engage the screen frame by means of an undercut groove formed in the underside of the screen elements. The undercut groove allows simple and easily mounted snap locking and also each individual element to be safely held.

The screen frame preferably comprises a longitudinally extending attachment section, to which the screen elements are fastened by snap locking by means of their undercut groove. The attachment section makes it possible to individually adjust the shape of the screen deck without structurally modifying the underlying frame structure.

In one embodiment, the attachment section is stepped in the longitudinal direction of the screen frame, whereby the screen elements fastened to the attachment section form a stepped screening surface. A stepped screening surface turns the material that is being screened and thus improves screening efficiency.

Moreover the attachment section is preferably symmetrical in the transverse direction to allow turning of the attachment section, which provides a longer life.

The screen elements of the screen are on their long sides preferably provided with at least one projection and/or at least one recess for locking engagement, in the longitudinal direction of the screen frame, with a corresponding projection and/or recess on neighbouring screen elements arranged in the screen frame. This gives the screen additional stability since the screen elements are not only supported by the attachment section but also locked to each other by the engagement between the projections/recesses on their short and long sides.

According to a characteristic feature, said at least one projection and/or recess on the longitudinal sides and the transverse sides, respectively, are arranged so that the screen element when rotated half a turn about an axis in the normal direction of the screen surface has the same circumferential shape. This property increases the flexibility and cost-efficiency of the screen since local wear on an individual screen element can be alleviated by turning of the individual screen element.

Furthermore the at least one projection and the at least one recess on the outer long sides of the transversely outermost screen elements engage a corresponding projection and/or recess in the wall guard of the screen frame, whereby these screen elements and thus the entire screening surface are locked. Due to the snap locking and the locking engagement, the screening surface cannot be moved, either transversely or longitudinally.

BRIEF DESCRIPTION OF THE DRAWINGS

The invention will in the following be described by way of example based on two embodiments and with reference to the accompanying drawings, in which.

DESCRIPTION OF PREFERRED EMBODIMENTS

Figure 1:
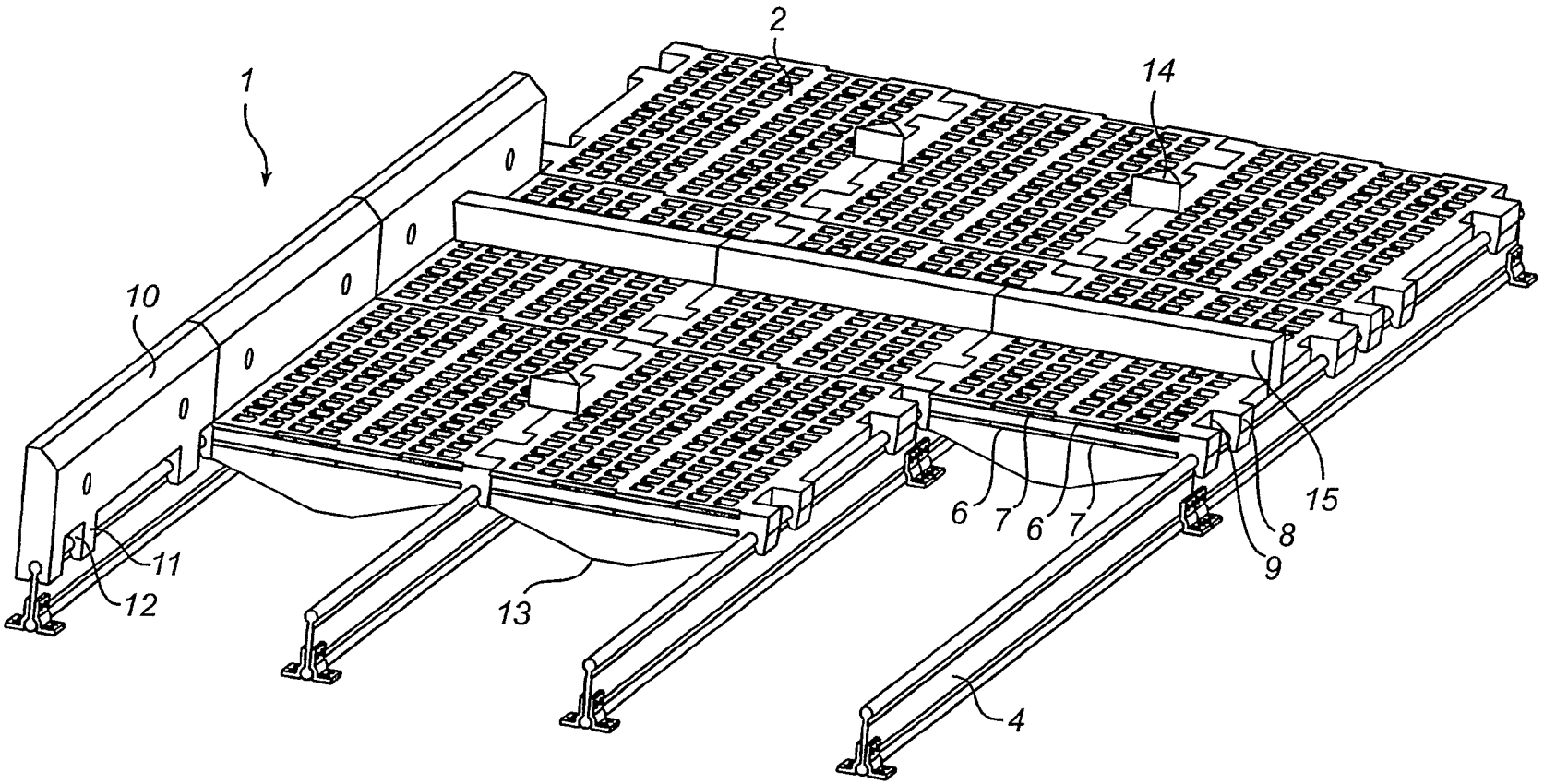
FIG. 1 is a perspective view of a screen according to a first embodiment of the invention.

The screen 1 shown in FIG. 1 comprises a plurality of screen elements 2 which are arranged by snap locking on a screen frame (not shown) via attachment sections 4 arranged on the screen frame. The snap locking consists of an undercut groove 5 which engages the attachment sections 4 arranged in the longitudinal direction of the screen 1.

Figure 2:
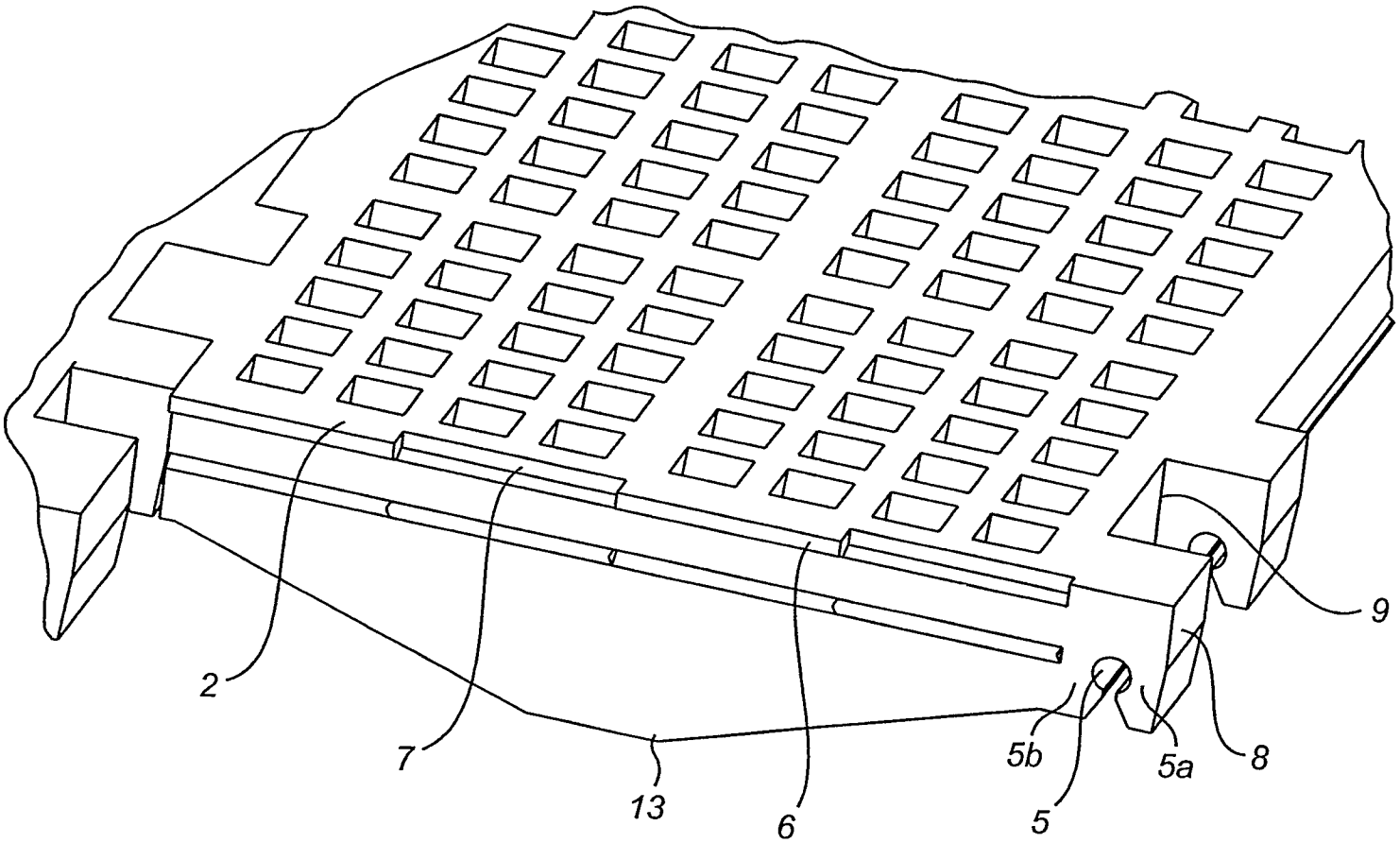
FIG. 2 is a perspective view of a detail of a screen element of the screen in FIG. 1.

The screen element 2 has, as is more clearly to be seen in FIG. 2, projections 6 and recesses 7 arranged on its transversely oriented transverse side or short side, which engage corresponding recesses 7 and projections 6 of neighbouring screen elements 2. Such locking engagement ensures relative locking of the short sides between longitudinally neighbouring screen elements. The locking is additionally improved by the projections 6 and the recesses 7 being formed at two levels. The screen element 2 is made of polyurethane of two different hardnesses. In the example shown, the upper side of the screen element is made of polyurethane of a lower hardness, approximately 78° Shore A, than the one that constitutes the underside of the screen. The hardness of the underside is in the example shown approximately 65° Shore D. Moreover, the material adjacent to the undercut groove 5 has two different hardnesses, so that the material on one side 5*a* of the groove 5 adapted to face a neighbouring screen element has lower hardness than the material on the opposite side 5*b* of the groove.

The longitudinally oriented long side of the screen element 2 further has projections 8 and recesses 9, which lockingly engage corresponding recesses 9 and projections 8 on neighbouring screen elements 2.

The recesses 7, 9 and the projections 6, 8 are arranged along the circumference of the screen element 2 in such a manner that the screen element can be rotated half a turn about an axis in the normal direction of the screening surface and then again be positioned in the screen 1. If the screen element 2 is worn at one point on its surface, it can thus be rotated half a turn, instead of being exchanged.

In this first embodiment, the screen element 2 has on its underside cambers 13 to increase its rigidity.

The screen frame wall guard 10, which is screwed to the screen frame wall (not shown), has projections 11 and recesses 12 which engage the projections 8 and the recesses 9 on the outer long sides of the transversely outermost screen elements 8, thereby locking these screen elements and thus also the entire screening surface. The snap locking and the locking engagement prevent the screening surface from being moved, either transversely or longitudinally.

Deflectors 14 and blocking strips 15 are mounted in recesses formed on the screen 1 in the screen elements 2.

FIGS. 5*a-c* show examples of cross-sections of the attachment section 4. The attachment sections used in the screen 1 in FIG. 1 are, as is more clearly to be seen in FIG. 5*a*, symmetrical so that they are turnable and therefore have a longer life before they need to be exchanged. Also the attachment sections 4 shown in FIGS. 5*b* and 5*c* are turnable.

Figure 3:
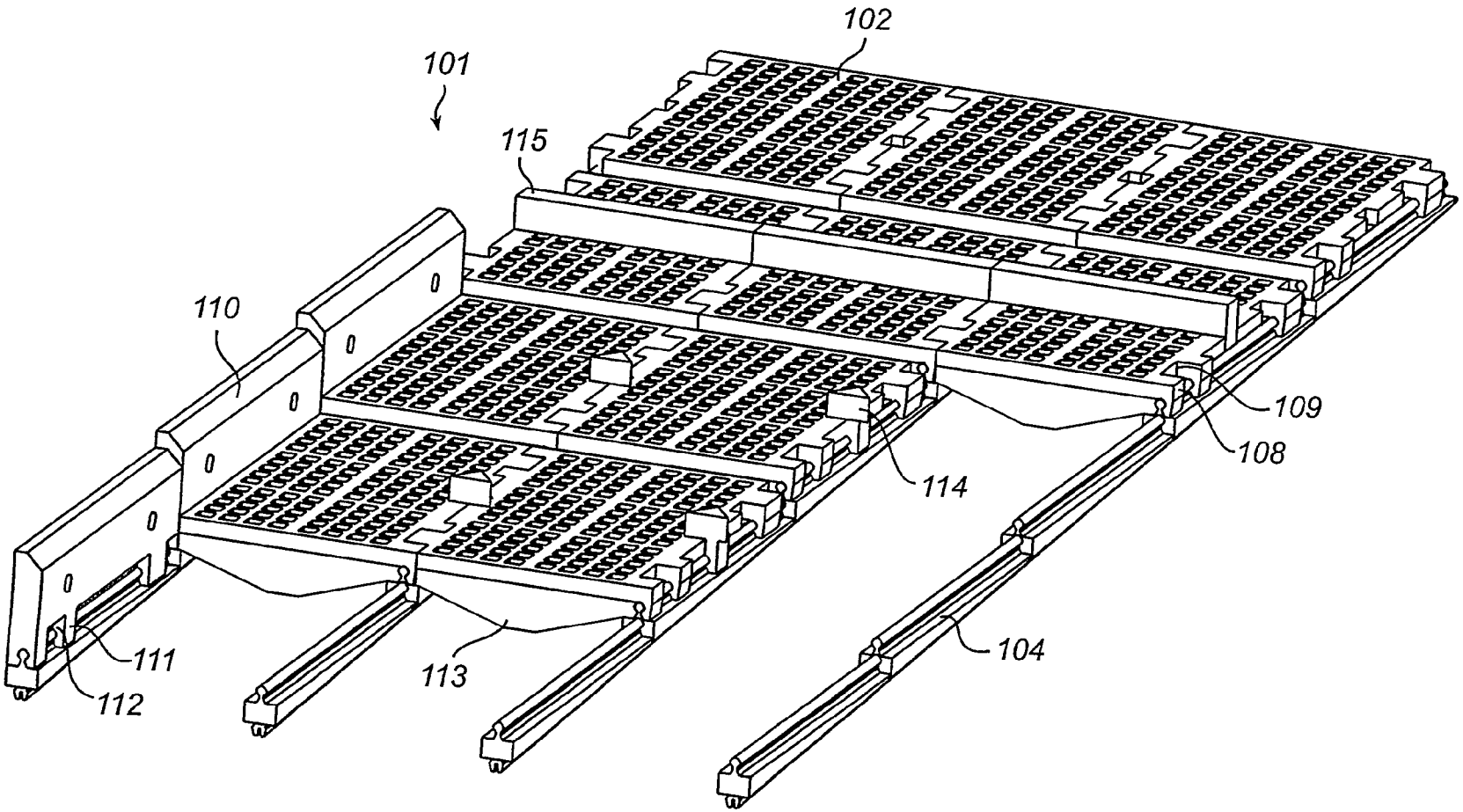
FIG. 3 is a perspective view of a screen according to a second embodiment of the invention.
Figure 4:
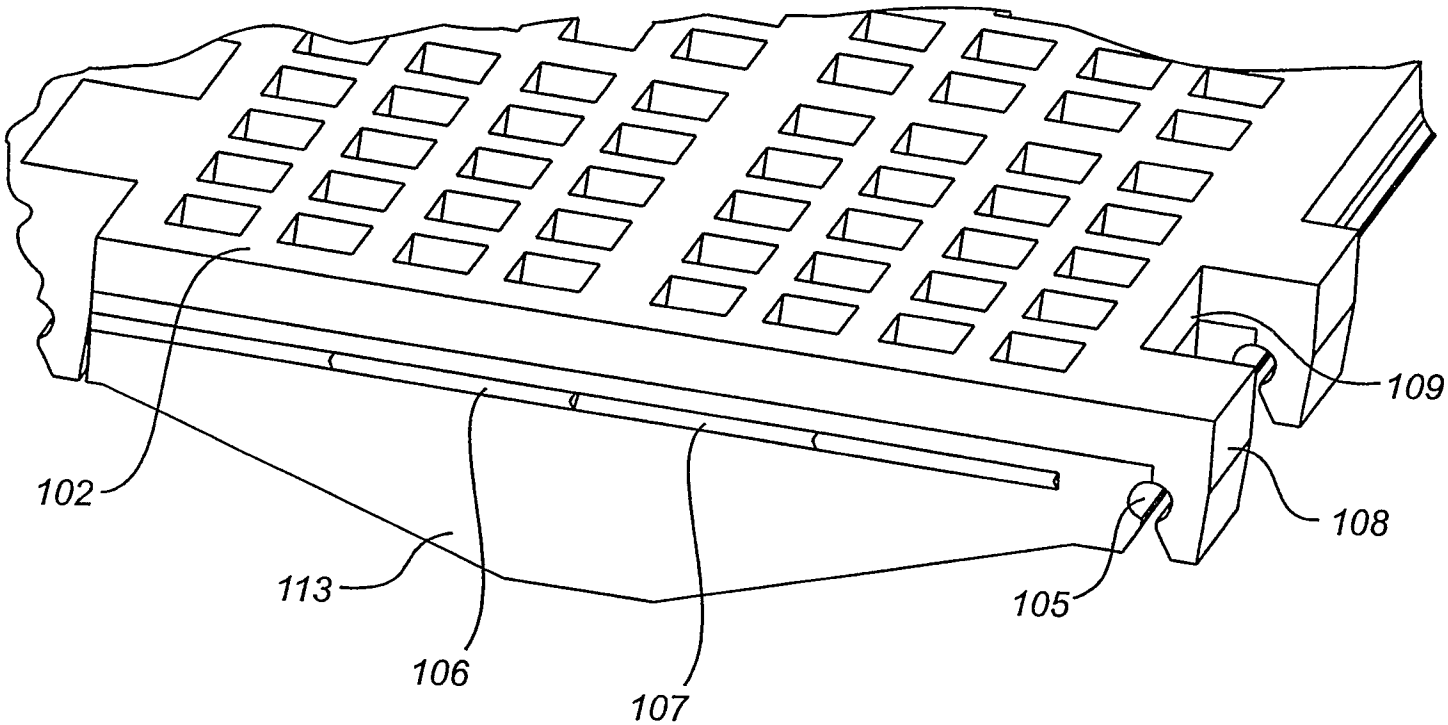
FIG. 4 is a perspective view of a detail of a screen element of the screen in FIG. 2, and FIGS. 5*a-f* are sectional views of attachment sections for attachment of the screen elements according to the invention.

According to a second embodiment of the inventive screen as shown in FIGS. 3 and 4, the attachment sections 104 of the screen 101 are stepped, whereby the screen elements 102 attached to the attachment sections 104 form a stepped screening surface, a so-called step deck. This embodiment is particularly useful in applications involving many fines, since the stepped screening surface turns the material that is being screened and in this manner improves the screening efficiency.

The projections 106 and the recesses 107 of the screen elements 102 here ensure increased tightness in the joint between successively arranged screen elements 102 compared with prior-art step decks.

The stepped attachment section 104 ensures an alternative way of providing a step deck. In prior-art step decks, the section has been straight and the screening elements have instead been placed overlapping each other.

FIGS. 5*d-f* show examples of cross-sections of the attachment section 104.

A person skilled in the art should realise that a large number of modifications of the here described embodiments of the invention are conceivable within the scope of the invention which is defined in the appended claims.

For example, the hardnesses of the material of which the screen elements are made can be varied depending on how the screen is to be used. Suitable hardnesses of the material in the upper side of the screen elements are in many cases 30-90° Shore A and in the underside 35-75° Shore D. The abrasion resistance of the screening surface can also be improved by means of ceramic elements.

Standard components, such as blocking strips and deflectors, can be mounted in other configurations and can also be completely excluded.

The shape of the attachment section can be appropriately designed; for instance the thickness of material and the distribution of material can be adjusted to the loads exerted, without deviating from the object of the invention.

In the two embodiments described, the elastomeric material of the screen elements can be reinforced with polycarbonate resin, when needed.

In the embodiments illustrated, the screening surface is an integral part of the screen elements, but this screening surface can be replaced by, for example, metal wire mesh or the like.

The invention claimed is:

1. A screen element made of elastomeric material and adapted to be arranged in a screen frame, which has at least two longitudinal sides arranged in a longitudinal direction of the screen frame and at least two transverse sides arranged in a transverse direction of the screen frame, wherein the at least two transverse sides are provided with at least one projection and/or at least one recess for locking engagement, in a direction transversely to the plane of the screen element, with a corresponding projection and/or recess on neighbouring screen elements arranged in the screen frame, and wherein the screen element on the at least two longitudinal sides is provided with at least one projection and/or at least one recess for locking engagement, in the longitudinal direction of the screen frame, with a corresponding projection and/or recess on neighbouring screen elements arranged in the screen frame, the screen element further comprising:

an underside, wherein the underside has an undercut groove for snap locking to the screen frame, the undercut groove extending in the longitudinal direction of the screen frame to be attached to a longitudinal attachment section of the screen frame; and wherein the elastomeric material adjacent to the undercut groove has two different hardnesses, so that the material on one groove side adapted to face a neighbouring screen element has a lower hardness than the material on the opposite side of the groove.

2. A screen element as claimed in claim 1, wherein the upper side of the screen element has a lower hardness than the underside of the screen element.

3. A screen element as claimed in claim 1, which is made of polyurethane.

4. A screen element as claimed in claim 3, further comprising a reinforcement of polycarbonate resin.

5. A screen element as claimed in claim 1, wherein said at least one projection and/or recess are arranged so that the screen element when rotated half a turn about an axis in the normal direction of the screen surface has a same perimeter shape.

6. A screen element as claimed in claim 1, wherein its underside is cambered.

7. A screen, which has a screen frame and screen elements arranged in the screen frame, the screen elements made of elastomeric material and having longitudinal sides arranged in a longitudinal direction of the screen frame and transverse sides arranged in a transverse direction of the screen frame, the transverse sides of each screen element are provided with at least one projection and/or at least one recess for locking engagement, in a direction transversely to the plane of the screen element, with a corresponding projection and/or recess on neighbouring screen elements arranged in the screen frame, and wherein the screen elements on their longitudinal sides are provided with at least one projection and/or at least one recess for locking engagement, in the longitudinal direction of the screen frame, with a corresponding projection and/or recess on neighbouring screen elements arranged in the screen frame, wherein the screen elements each further comprises:

an underside, wherein the underside has an undercut groove for snap locking to the screen frame, the undercut groove extending in the longitudinal direction of the screen frame to be attached to a longitudinal attachment section of the screen frame; and wherein the elastomeric material adjacent to the undercut groove has two different hardnesses, so that the material on one groove side adapted to face a neighbouring screen element has a lower hardness than the material on the opposite side of the groove.

8. A screen as claimed in claim 7, wherein the screen elements are fastened to the screen frame by snap locking by means of an undercut groove formed on the underside of the screen elements.

9. A screen as claimed in claim 8, wherein the screen frame comprises an attachment section extending in the longitudinal direction, and wherein the screen elements are fastened to the attachment section by snap locking by means of the undercut groove.

10. A screen as claimed in claim 9, wherein the attachment section in the longitudinal direction of the screen frame is stepped, whereby the screen elements fastened to the attachment section form a stepped screening surface.

11. A screen as claimed in claim 9, wherein the attachment section is symmetrical in cross-section.

12. A screen as claimed in claim 7, wherein said at least one projection and/or recess are arranged so that each screen element when rotated half a turn about an axis in the normal direction of the screen surface has a same perimeter shape.

13. A screen as claimed in claim 7, wherein the screen frame at its outer sides in the transverse direction has longitudinal sides provided with side wall guards, with which the screen elements arranged at the transversely outer sides of the screen frame are engaged to lock the screen elements in the longitudinal direction of the screen frame.

* * * * *

UNITED STATES PATENT AND TRADEMARK OFFICE

CERTIFICATE OF CORRECTION

PATENT NO. : 8,469,199 B2
APPLICATION NO. : 11/662863
DATED : June 25, 2013
INVENTOR(S) : Lars Gronvall and Kalle Larsson It is certified that error appears in the above-identified patent and that said Letters Patent is hereby corrected as shown below:

Title page of Patent, item (57), Abstract, line 9,
Delete "neighboring"
Insert --neighbouring--

Signed and Sealed this
Nineteenth Day of November, 2013

Teresa Stanek Rea

Teresa Stanek Rea
*Deputy Director of the United States Patent and Trademark Office*